US009190223B2

(12) United States Patent
Felden et al.

(10) Patent No.: US 9,190,223 B2
(45) Date of Patent: Nov. 17, 2015

(54) ROTOR HOUSING OF AN ELECTRICAL SWITCHING DEVICE AND ELECTRICAL SWITCHING DEVICE

(71) Applicants: Walter Felden, Rieden (DE); Timo Malich, Amberg (DE); Siegfried Pirker, Ensdorf (DE)

(72) Inventors: Walter Felden, Rieden (DE); Timo Malich, Amberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 60 days.

(21) Appl. No.: 13/664,773

(22) Filed: Oct. 31, 2012

(65) Prior Publication Data

US 2013/0105287 A1 May 2, 2013

(30) Foreign Application Priority Data

Nov. 2, 2011 (DE) ..... 10 2011 085 606

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |

(Continued)

(52) U.S. Cl.

CPC ..... *H01H 1/2041* (2013.01); *H01H 73/045* (2013.01)

(58) Field of Classification Search

CPC ..... H01H 9/28; H01H 9/0027; H01H 9/02; H01H 73/00; H01H 73/06; H01H 75/00; H01H 77/00; H01H 85/045; H01H 85/05; H01H 2019/00

USPC ..... 200/1 R, 5 R, 16 R, 410, 502, 19.2, 200/19.22, 19.27, 19.3, 293, 294, 295, 200/302.3, 244, 401; 335/16

See application file for complete search history.

(56) References Cited

U.S. PATENT DOCUMENTS

| | | | | |
|---|---|---|---|---|
| 3,703,616 | A * | 11/1972 | Martin | 200/56 R |
| 6,278,619 | B1 * | 8/2001 | Dumont | 361/837 |
| 2004/0256207 | A1 * | 12/2004 | Azzola et al. | 200/244 |

(Continued)

FOREIGN PATENT DOCUMENTS

| | | | |
|---|---|---|---|
| DE | 19933919 | A1 | 1/2001 |
| DE | 69703174 | T2 | 5/2001 |

(Continued)

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A rotor housing of an electrical switching device, in particular a compact circuit breaker, is disclosed. In at least one embodiment, the rotor housing is embodied to mount a moveable contact arm bridge and includes a first and a second rotor housing element, which can be connected in a form-fit manner to one another and which can surround the contact arm bridge at least in sections when in the connected state. An electrical switching device is also disclosed, in particular a compact circuit breaker, including a moveably mounted contact arm bridge, an opening mechanism and a rotor housing of this type for mounting the moveable contact arm bridge.

19 Claims, 11 Drawing Sheets

(51) Int. Cl.
*H01H 1/20* (2006.01)
*H01H 73/04* (2006.01)

(56) References Cited

U.S. PATENT DOCUMENTS

| | | | | |
|---|---|---|---|---|
| 2006/0077022 | A1* | 4/2006 | Kim | 335/16 |
| 2008/0024252 | A1* | 1/2008 | Gallas et al. | 335/18 |

FOREIGN PATENT DOCUMENTS

| | | | |
|---|---|---|---|
| DE | 10319192 | B3 | 12/2004 |
| DE | 102009052965 | | 7/2011 |
| EP | 795662 | B1 | 9/1997 |
| EP | 1196936 | B1 | 4/2002 |
| WO | WO 01/06530 | | 1/2001 |
| WO | WO2011058120 | A1 | 5/2001 |

* cited by examiner

ROTOR HOUSING OF AN ELECTRICAL SWITCHING DEVICE AND ELECTRICAL SWITCHING DEVICE

PRIORITY STATEMENT

The present application hereby claims priority under 35 U.S.C. §119 to German patent application number DE 10 2011 085 606.4 filed Nov. 2, 2011, the entire contents of which are hereby incorporated herein by reference.

FIELD

At least one embodiment of the invention generally relates to a rotor housing of an electrical switching device, in particular a compact circuit breaker, wherein the rotor housing is embodied to mount a moveable contact arm bridge. At least one embodiment of the invention further generally relates to an electrical switching device, in particular a compact circuit breaker, comprising a moveably mounted contact arm bridge, an opening mechanism and for mounting the moveable contact arm bridge, a rotor housing.

BACKGROUND

An electrical switching device, such as for instance a compact circuit breaker, has one or more moveable contact arm bridges, in order to open and close a current circuit. In the switched-on state, the contact arm bridge is to securely close the current circuit. In the event of a short circuit, the contact arm bridge is to open very quickly by electrodynamic forces independently of an actuation mechanism, for instance a latch and an over-current release, of the electrical switching device. This is ensured by way of various opening mechanisms. The moveably mounted contact arm bridge with the opening mechanism is mounted in a rotor housing. The rotor housing generally consists of a single element. Depending on the opening mechanism, it may be necessary for the rotor housing to consist of two or more elements.

SUMMARY

An at least two-part rotor housing is disclosed for an electrical switching device, in particular for a compact circuit breaker, which safely withstands large loads, for instance high compressive loads in the event of a short circuit.

A rotor housing for an electrical switching device and an electrical switching device are disclosed. Further features and details of the invention result from the subclaims, the description and the appended drawings. In these aspects the features which are described in conjunction with embodiments of the inventive rotor housing also naturally apply in conjunction with embodiments of the inventive electrical switching device and in each instance conversely, so that with respect to the disclosure of the individual aspects of the embodiments, reciprocal reference is or can always be made.

According to a first aspect of an embodiment of the invention, a rotor housing of an electrical switching device, in particular of a compact circuit breaker, is disclosed wherein the rotor housing is embodied to mount a moveable contact arm bridge, and wherein the rotor housing comprises a first and a second rotor housing element, which can be connected to one another in a form-fit manner and which, in the connected state, may surround the contact arm bridge at least in sections. A rotor housing of this type for an electrical switching device, in particular for a compact circuit breaker, withstands large loads, for instance high compressive loads in the event of a short circuit. The two-part embodiment of the rotor housing enables simple assembly of the contact arm bridge mounted moveably in the rotor housing and if necessary an opening mechanism. As a result of the two rotor housing elements, in other words the first and the second rotor housing element, being fixed to one another, these cannot be separated in the event of large loads, in comparison with rotor housing elements which are not connected to one another. A rotor housing embodied in this way is able to withstand high loads both in an axial and also in a radial direction. The first and the second rotor housing element can be connected to one another here in a form-fit manner.

According to a second aspect of an embodiment of the invention, an electrical switching device is disclosed, in particular by a compact circuit breaker, wherein the electrical switching device or the compact circuit breaker has a moveably mounted contact bridge, if necessary an opening mechanism and for mounting the moveable contact bridge a rotor housing according to the embodiment of the first aspect of the invention. An electrical switching device embodied in this way, in particular compact circuit breaker, can withstand high loads, since the two rotor housing elements of the rotor housing are securely fastened to one another. In particular, if high compressive loads occur, such as for instance in the event of a short circuit, electrical switching devices embodied in this way are particularly secure. Electrical switching devices of this type are at the same time particularly durable.

BRIEF DESCRIPTION OF THE DRAWINGS

The invention is described and explained in more detail below with the aid of the example embodiments shown in the Figures, in which.

Elements with the same function and mode of operation are provided with the same reference characters in FIGS. 1 to 13 in each instance.

DETAILED DESCRIPTION OF THE EXAMPLE EMBODIMENTS

Figure 1:
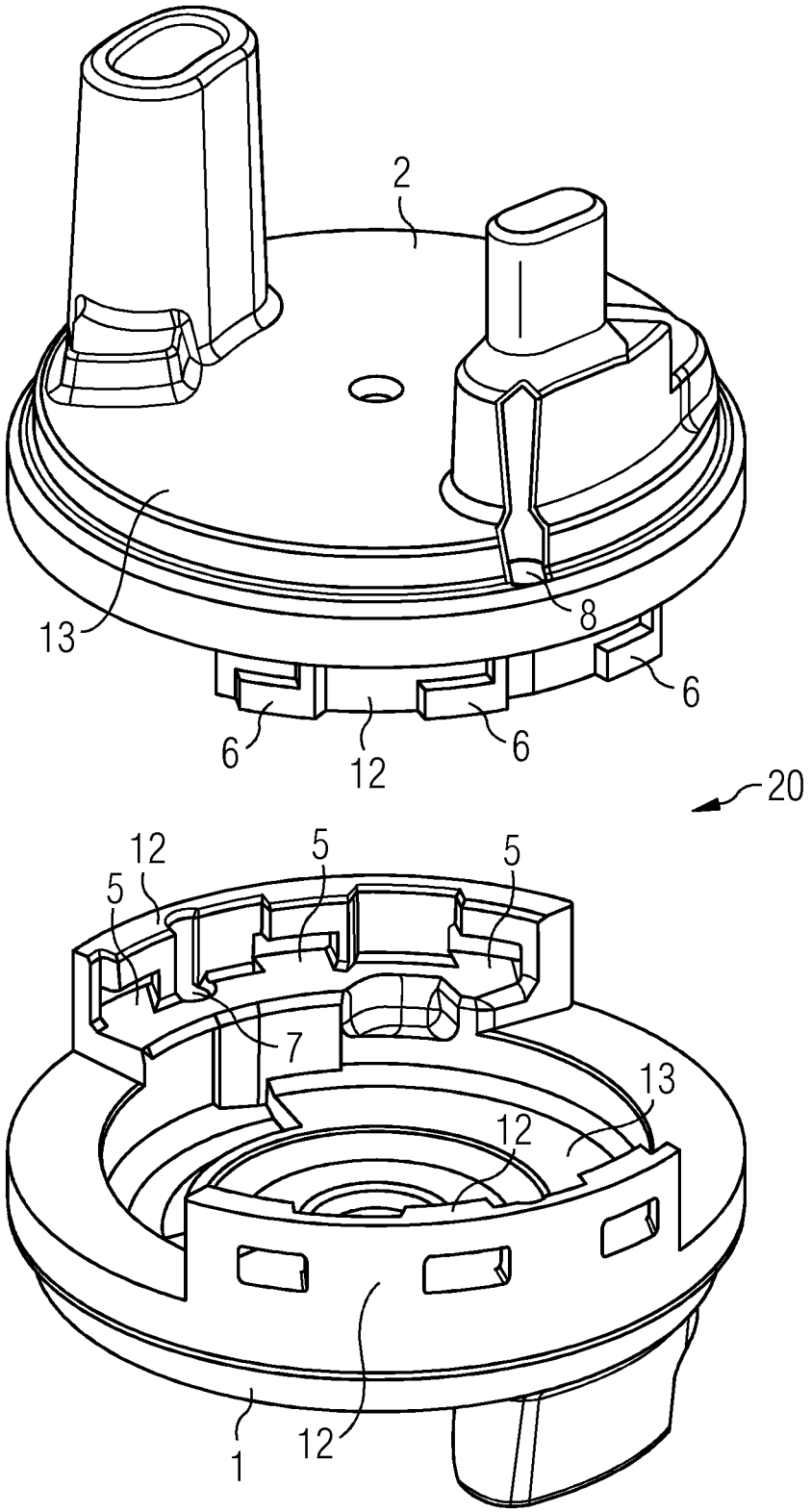
FIG. 1 shows a first rotor housing in a perspective view, comprising a first rotor housing element and a second rotor housing element, which are embodied in accordance with the inventive construction principle.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of an embodiment of the invention, a rotor housing of an electrical switching device, in particular of a compact circuit breaker, is disclosed wherein the rotor housing is embodied to mount a moveable contact arm bridge, and wherein the rotor housing comprises a first and a second rotor housing element, which can be connected to one another in a form-fit manner and which, in the connected state, may surround the contact arm bridge at least in sections. A rotor housing of this type for an electrical switching device, in particular for a compact circuit breaker, withstands large loads, for instance high compressive loads in the event of a short circuit. The two-part embodiment of the rotor housing enables simple assembly of the contact arm bridge mounted moveably in the rotor housing and if necessary an opening mechanism. As a result of the two rotor housing elements, in other words the first and the second rotor housing element, being fixed to one another, these cannot be separated in the event of large loads, in comparison with rotor housing elements which are not connected to one another. A rotor housing embodied in this way is able to withstand high loads both in an axial and also in a radial direction. The first and the second rotor housing element can be connected to one another here in a form-fit manner.

In the connected state, the first and the second rotor housing element of the rotor housing surround the moveably mounted contact arm bridge and if necessary an opening mechanism at least in sections. In particular, the rotor housing elements surround the base body of the contact arm bridge and if necessary an opening mechanism, whereupon the ends of the contact arm bridge, on which the contacts are arranged, are not surrounded by the rotor housing elements. This ensures that contacts of the moveably mounted contact arm bridge can contact a fixed contact of the electrical switching device.

As a result of the first and second rotor housing element being connected to one another in a form-fit manner, this ensures that this puts less of a load on the contact arm bridge and if necessary an opening mechanism for the contact arm bridge. Furthermore, the form-fit connection of the rotor housing elements ensures that the contact arm bridge or an opening mechanism arranged if necessary in the rotor housing are embodied simply, since these have no complicated fastening elements for fastening to the rotor housing elements.

According to a preferred development of at least one embodiment of the invention, provision can be made in a rotor housing for the rotor housing elements to be connectable to one another in a form fit manner by way of at least one bayonet fitting. A particularly simple fastening of the first rotor housing element to the second rotor housing element of the rotor housing is herewith provided. A bayonet fitting of this type ensures a mechanical connection of the two rotor housing elements which can be quickly established and quickly released. The rotor housing elements are connected by fitting them together and turn them against one another and separated by reversing the process. This means that only a plug-rotate movement of the two rotor housing elements is required for a form-fit connection of the two rotor housing elements.

Provision can particularly preferably be made in a rotor housing for at least one first bayonet fitting contour to be embodied on the first rotor housing element and at least one second bayonet fitting contour for receiving the at least one first bayonet fitting contour to be embodied on the second rotor housing element. In this arrangement the first and the second bayonet fitting contour may have the same dimensions and forms. It is however also conceivable for the first bayonet fitting contour to be embodied differently to the second bayonet fitting contour. The first bayonet fitting contour can therefore be formed for instance by at least one projection protruding on the rotor housing element, in particular pin, which can be inserted into at least one second bayonet fitting contour of the second rotor housing element which is embodied as an angled guiding contour. If the first and the second bayonet fitting contours are embodied the same, in the case of the two rotor housing elements, they are however arranged in the counterclockwise direction on the respective rotor housing element, so that they can engage with each in a form-fit manner by way of rotation after being fitted together.

According to a particularly preferred further development of at least one embodiment of the invention, provision can be made in a rotor housing for an arresting element for latching together the first rotor housing element and the second rotor housing element in a state of the two rotor housing elements connected by the bayonet fitting. This means that after connecting the first and second rotor housing element in a form-fit manner, an arresting element can additionally secure the connection. In this process the arresting element engages with the rotor housing elements such that rotation of the rotor housing elements relative to one another is prevented. A rotor housing embodied in this way allows for a particularly high stress or load on the rotor housing. The additional arresting element particularly reliably prevents the release of the form-fit connection.

The arresting element may be embodied in various ways. The arresting element may be a clamping element or a latching element for instance. Provision can particularly preferably be made in a rotor housing for the first rotor housing element and the second rotor housing element to each comprise a plug-in receptacle for receiving an arresting element embodied as a plug-in element, wherein the two plug-in receptacles are arranged in the first and the second rotor housing element such that, in order to receive the plug-in element, they are arranged flush with one another when the two rotor housing elements are in the connected state. This means that both in the first rotor housing element and also in the second rotor housing element, a plug-in receptacle, which is embodied in particular as a hole or a through hole, are provided and when the two rotor housing elements are attached to one another in the connected state, the two plug-in receptacles are arranged flush with one another so that a shared plug-in element can be guided through both plug-in receptacles. This particularly simply ensures that the rotor housing elements connected in a form-fit manner cannot rotate relative to one another. The form-fit connection of the two rotor housing elements is ensured by the additional arresting element, in particular the plug-in element inserted into the plug-in receptacles, in a simple and cost-effective manner. The plug-in element can additionally be secured by a splint, so that this can also not slip out of the plug-in receptacles of the rotor housing elements.

The plug-in element may be embodied in various ways. The plug-in element may be embodied, for example, as a pin or molded part, since this can be produced on the one hand in a simple and cost-effective manner and on the other hand can be easily inserted in correspondingly embodied plug-in receptacles in the first and second rotor housing element.

The rotor housing and thus the two rotor housing elements can be embodied from plastic. In particular, the rotor housing or the two rotor housing elements, in which the rotor housing elements can be connected in a form-fit manner to one another by way of a bayonet fitting, can be embodied from a thermosetting material. With this connection concept, no elastic deformation of the rotor housing elements is necessary. Rotor housing elements embodied from thermosetting material have very good mechanical, thermal and insulation properties.

According to another example further development of the invention, provision can be made in a rotor housing for the first rotor housing element to comprise at least one snap-fit hook and the second rotor housing element to comprise a mating contour, into which the at least one snap-fit hook can engage. Provision can naturally also be made here for the at least one snap-fit hook to be arranged on the second rotor housing element and for the at least one mating contour to be arranged on the first rotor housing element.

A number of snap-fit hooks and correspondingly more mating contours are particularly preferably provided on the two rotor housing elements. The two rotor housing elements can be easily connected to one another in a form-fit manner by the at least one snap-fit hook and the at least one mating contour. In the assembled state of the two rotor housing elements, the rotor housing can accommodate high forces in the axial and radial direction. This ensures that the rotor housing withstands high loads, for instance high compressive loads in the event of a short circuit.

A rotor housing embodied in this way is cost-effective in terms of manufacture and similarly cost-effective in terms of assembly, in other words when the two rotor housing elements are connected to one another using a form fit. In particular, a rotor housing embodied in this way is embodied in a simple and cost-effective manner, since no further arresting elements are required to ensure the form-fit connection.

The connection of a first rotor housing element which comprises at least one snap-fit hook to a second rotor housing element which comprises at least one mating contour, into which the at least one snap-fit hook can engage, is simple and at the same time secure. In other words, a secure form-fit connection can be easily established by plugging the first rotor housing element onto the second rotor housing element. A subsequent rotation is not necessary in this embodiment of the form-fit connection.

In an example further development of the invention, provision can be made in a last described rotor housing for at least one snap-fit hook and also at least one mating contour to be provided on the first rotor housing element and for at least one snap-fit hook and at least one mating contour to be provided on the second rotor housing element.

According to an example further development of the invention, provision can be made with a rotor housing for three or more snap-fit hooks and accordingly three or more mating contours, which are arranged at a distance from one another on the first rotor housing element and on the second rotor housing element. Therefore three or four snap-fit hooks can be arranged on the first rotor housing element for instance, wherein all snap-fit hooks are arranged at the same distance from the respectively adjacent snap-fit hooks. The same applies to the mating contours on the second rotor housing element. These can also be arranged at the same distance from the adjacent mating contours in each instance. This ensures that the two rotor housing elements are fastened evenly to one another across their periphery.

According to an example further development of the invention, provision can be made in a rotor housing for the at least one snap-fit hook to be embodied in a spring elastic manner. The at least one spring elastic snap-fit hook on the first rotor housing element ensures that this can latch securely into the corresponding mating contour of the second rotor housing element and can thus engage behind the mating contour in a form-fit manner. The first rotor housing element is herewith securely but detachably fastened to the second rotor housing element both axially and also in the radial direction.

The rotor housing and thus the two rotor housing elements can be embodied from plastic. In particular, a rotor housing, in which the rotor housing elements can be connected to one another in a form-fit manner by at least one snap-fit hook and at least one corresponding mating contour, can be embodied from a thermoplastic material, since with this connection concept, an elastic deformation of the at least one snap-fit hook is necessary. In other words, the rotor housing elements which comprise at least one snap-fit hook are advantageously embodied from a thermoplastic material, which has better spring elastic properties than thermosetting material.

According to a further example development of the invention, provision can be made in one rotor housing for the rotor housing elements to comprise drilled holes through which a rotor shaft can pass. Furthermore, the rotor housing elements are preferably embodied such that these comprise receiving areas for receiving a rotor, an opening mechanism for the contact arm bridge and for at least regions of the contact arm bridge.

Provision can therefore preferably be made in rotor housing for at least one of the rotor housing elements to be embodied as a cap, comprising a base body and a flange section wherein at least one recess for moveably guiding the contact arm bridge is embodied in the flange section. Both the first rotor housing element and also the second rotor housing element are advantageously embodied as a cap, in each instance with a base body and a peripheral flange section. The flange sections are arranged here on the rotor housing elements such that with a form-fit fastening of the two rotor housing elements to one another, the flange sections protrude in the direction of the other rotor housing element in each instance. Each rotor housing element preferably comprises two recesses, so that the moveably mounted contact arm bridge can be passed through both recesses, in order to reach the closed or opened position.

The at least one first bayonet fitting contour of the first rotor housing element and the at least one second bayonet fitting contour of the second rotor housing element can preferably be arranged in or on the flange sections of the two rotor housing elements. The same applies to the embodiment variant of the rotor housing having snap-fit hooks on at least the first rotor housing element and the mating contours on the second rotor housing element. It is also advantageous here for the at least one snap-fit hook and the at least one mating contour to be arranged on the flange sections of the respective rotor housing elements. This ensures a particularly simple and rapid form-fit connection between the two rotor housing elements.

According to a further example development of the invention, provision can be made in a rotor housing for the first and the second rotor housing element also to be connectable to one another in a force-fit manner. Provision can therefore be made for instance for the bayonet fitting of the first and second rotor housing element to connect the two rotor housing elements adjacent to the form-fit connection also in a force-fit manner. For instance, this can take place by way of a frictional connection between the at least one first bayonet fitting contour of the first rotor housing element and the at least one second bayonet fitting contour of the second rotor housing element. In other words, the rotor housing element and/or the bayonet fitting contours of the rotor housing elements are preferably embodied such that with the rotational movement of the rotor housing elements relative to one another, the bayonet fitting contours engage in one another in a force-fit, in particular frictional manner, so that in the connected state, the first rotor housing element and the second rotor housing element are fastened to one another in a form and force-fit manner.

The rotor housing variant, in which the first rotor housing element comprises at least one snap-fit hook and the second rotor housing element comprises at least one mating contour receiving the snap-fit hook, can be connected in a force-fit manner. In other words, the at least one snap-fit hook of the first rotor housing element can, in addition to engaging behind the at least one mating contact of the second rotor housing element in a form-fit manner, also engage therebehind in a force-fit manner. A particularly secure fastening of the two rotor housing elements to one another is herewith ensured. It is also ensured with both variants that the two rotor housing elements can be released again from one another by applying a certain force. Both the assembly and also the disassembly of a contact arm bridge and if necessary an opening mechanism for the contact arm bridge is herewith easily ensured in the rotor housing and/or out of the rotor housing.

The arresting element which might also be provided in addition can if necessary also be arranged in a force-fit manner on the two rotor housing elements, if these are connected to one another in a form-fit manner.

According to a second aspect of an embodiment of the invention, an electrical switching device is disclosed, in particular by a compact circuit breaker, wherein the electrical switching device or the compact circuit breaker has a moveably mounted contact bridge, if necessary an opening mechanism and for mounting the moveable contact bridge a rotor housing according to the embodiment of the first aspect of the invention. An electrical switching device embodied in this way, in particular compact circuit breaker, can withstand high loads, since the two rotor housing elements of the rotor housing are securely fastened to one another. In particular, if high compressive loads occur, such as for instance in the event of a short circuit, electrical switching devices embodied in this way are particularly secure. Electrical switching devices of this type are at the same time particularly durable.

FIG. 1 shows a schematic representation of a rotor housing 20 for an electrical switching device, in particular for a contact circuit breaker, wherein the rotor housing 20 is embodied to mount a moveable contact arm bridge 10 and if necessary for an opening mechanism 11 for the contact arm bridge 10. The rotor housing 20 comprises a first rotor housing element 1 and a second rotor housing element 2, which can be connected to one another in a form-fit manner. In this embodiment variant of the rotor housing 20, the first and the second rotor housing element 1, 2 can be connected to one another in a form-fit manner by way of a bayonet fitting 5,6.

Figure 2:
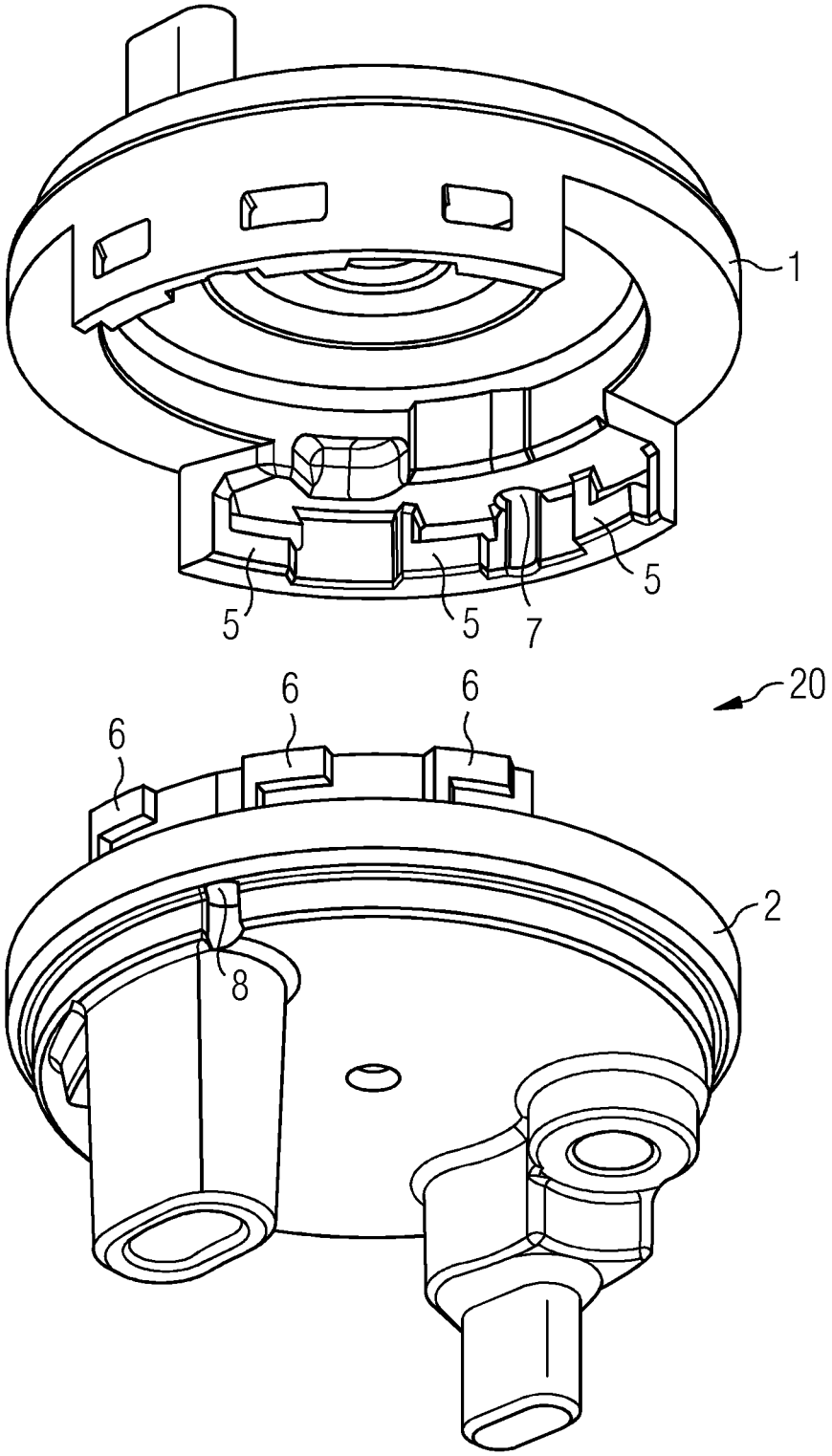
FIG. 2 shows the rotor housing according to FIG. 1, in another perspective view.

Several first bayonet fitting contours 5 are embodied on the first rotor housing element 1 and second bayonet fitting contours 6 are embodied on the first and the second rotor housing element 5 in each instance. The first bayonet fitting contours 5 are embodied for a form-fit engagement into the second bayonet fitting contours 6 of the second rotor housing element 2. In this way the first bayonet fitting contours 5 and the second bayonet fitting contours 6 are arranged on the respective rotor housing elements 1, 2 such that the second rotor housing element 2 plugs into the first rotor housing element 1 and can then be rotated relative to the same or vice versa. After rotating the rotor housing elements 1, 2 relative to one another, these are connected to one another in a form-fit manner. The first rotor housing element 1 and also the second rotor housing element 2 each comprise a base body 13 and two flange sections 12, which extend from the base body 13. Both the first bayonet fitting contours 5 of the first rotor housing element 1 and also the second bayonet fitting contours 6 of the second rotor housing element 2 are arranged in the respective flange sections 12 of the rotor housing elements 1, 2. FIG. 2 shows another perspective view of the two rotor housing elements 1, 2 of the inventive rotor housing 20.

Figure 3:
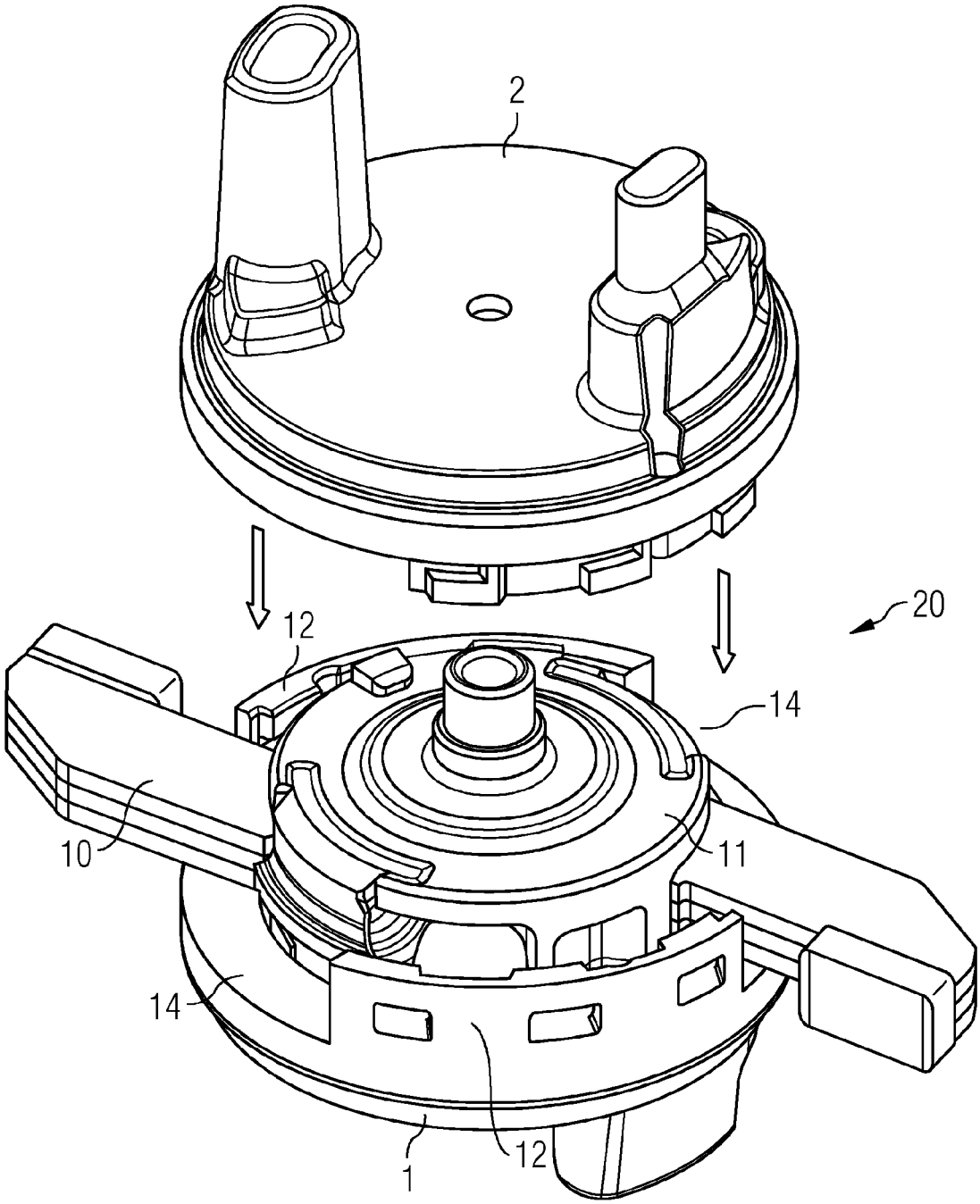
FIG. 3 shows the rotor housing elements of the rotor housing according to FIGS. 1 and 2 having a contact arm bridge arranged in the first rotor housing element with an opening mechanism.

FIG. 3 shows a schematic perspective view of a rotor housing 20 according to FIG. 1 and FIG. 2. The two rotor housing elements 1, 2 are not connected to one another. A contact arm bridge 10 with an opening mechanism 11 is placed in the first rotor housing element 1. The second rotor housing element 2 can be plugged onto the first rotor housing element 1 by means of the second bayonet fitting contour 6, see FIG. 1, and connected herewith in a form-fit manner by rotating the same relative hereto. In the connected state, the contact arm bridge 10, in particular the opening mechanism 11, is sealed at least in sections by the first rotor housing element 1 and the second rotor housing element 2. The arms and thus the contacts of the contact arm bridge 10 are held moveably in the recesses 14 of the rotor housing elements 1, 2 so that the contact arm bridge 10 or the contacts of the contact arm bridge 10 cannot open or close fixed contacts (not shown) of an electrical switching device.

Figure 4:
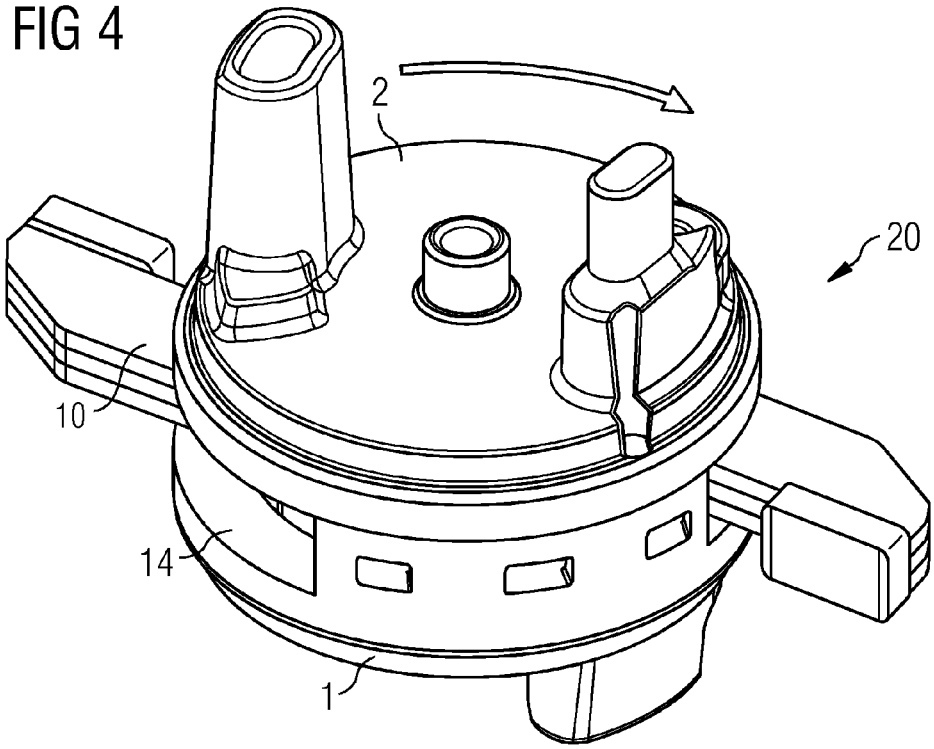
FIG. 4 shows the rotor housing according to FIG. 3 during the fastening process of the two rotor housing elements to one another.

FIG. 4 shows the rotary movement when the bayonet fittings 5, 6 of the first rotor housing element 1 and of the second rotor housing element 2 are closed together. The rotary movement is indicated by the arrow shown in black. The contact arm bridge 10 is mounted moveably within the rotor housing 20 and can move into the recesses 14 of the rotor housing 20.

Figure 5:
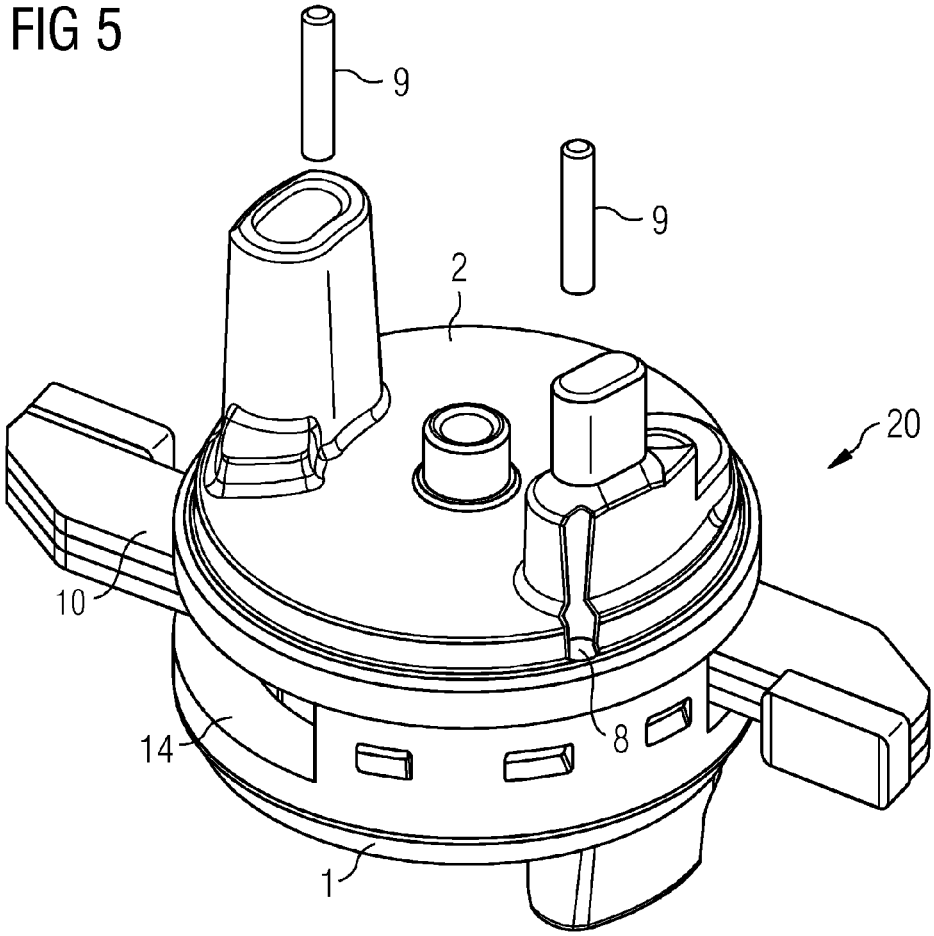
FIG. 5 shows the rotor housing according to FIGS. 3 and 4 in the connected state.

FIG. 5 shows the rotor housing 20 according to FIG. 4 in the connected state. Plug-in receptacles 7, 8, see also FIG. 1, are provided both in the first rotor housing element 1 and also in the second rotor housing element 2, into which arresting elements 9, which are embodied here in the form of plug-in elements or pins, can be inserted. The plug-in receptacles 7, 8 on the respective rotor housing elements 1, 2 are arranged here on the rotor housing elements 1, 2 such that in the form-fit connected state of the rotor housing elements 1 to one another, the plug-in receptacles 7, 8 are arranged flush with one another. The arresting elements 9 preferably embodied as pins or molded parts can be pushed through the respective plug-in receptacles 7, 8 of the rotor housing elements 1, 2 so that the two rotor housing elements 1, 2 cannot be rotated relative to one another. The additional arresting of the first rotor housing element 1 on the second rotor housing element 2 ensures that the form-fit connection of the two rotor housing elements 1, 2 cannot be released.

Figure 6:
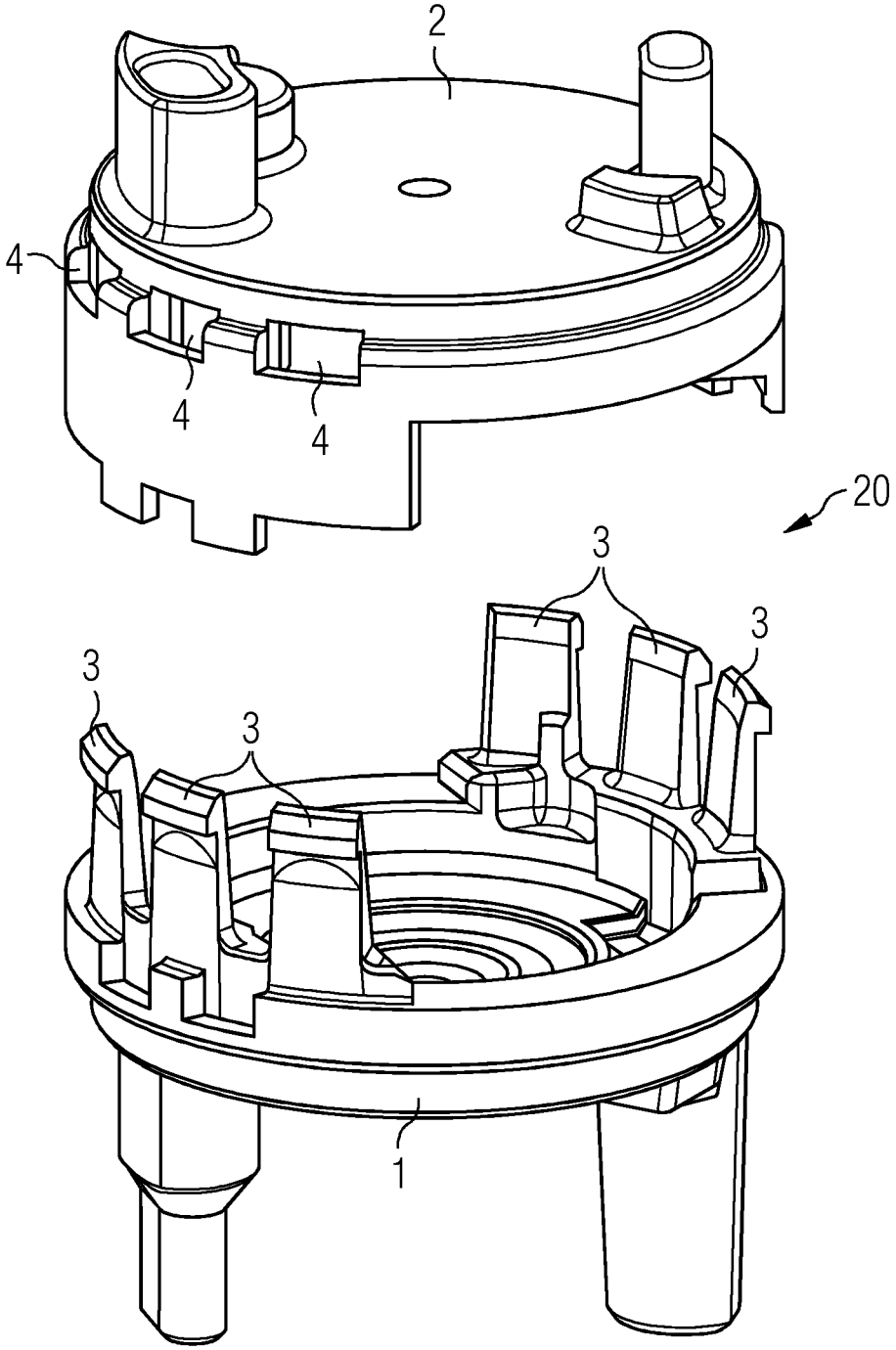
FIG. 6 shows another rotor housing, having snap-fit hooks on the first rotor housing element and corresponding mating contours on the second rotor housing element.

FIG. 6 shows another rotor housing 20, which is embodied in accordance with the inventive construction principle. The two rotor housing elements 1, 2 are shown in the non-connected state. A number of protruding snap-fit hooks 3 is arranged on the first rotor housing element 1 of the rotor housing 20, which can engage in correspondingly embodied mating contours 4 of the second rotor housing element 2. The snap-fit hooks 3 are preferably embodied in a spring-elastic manner, so that they can easily and securely engage or snap into the corresponding mating contours 4 on the second rotor housing element 2.

Figure 7:
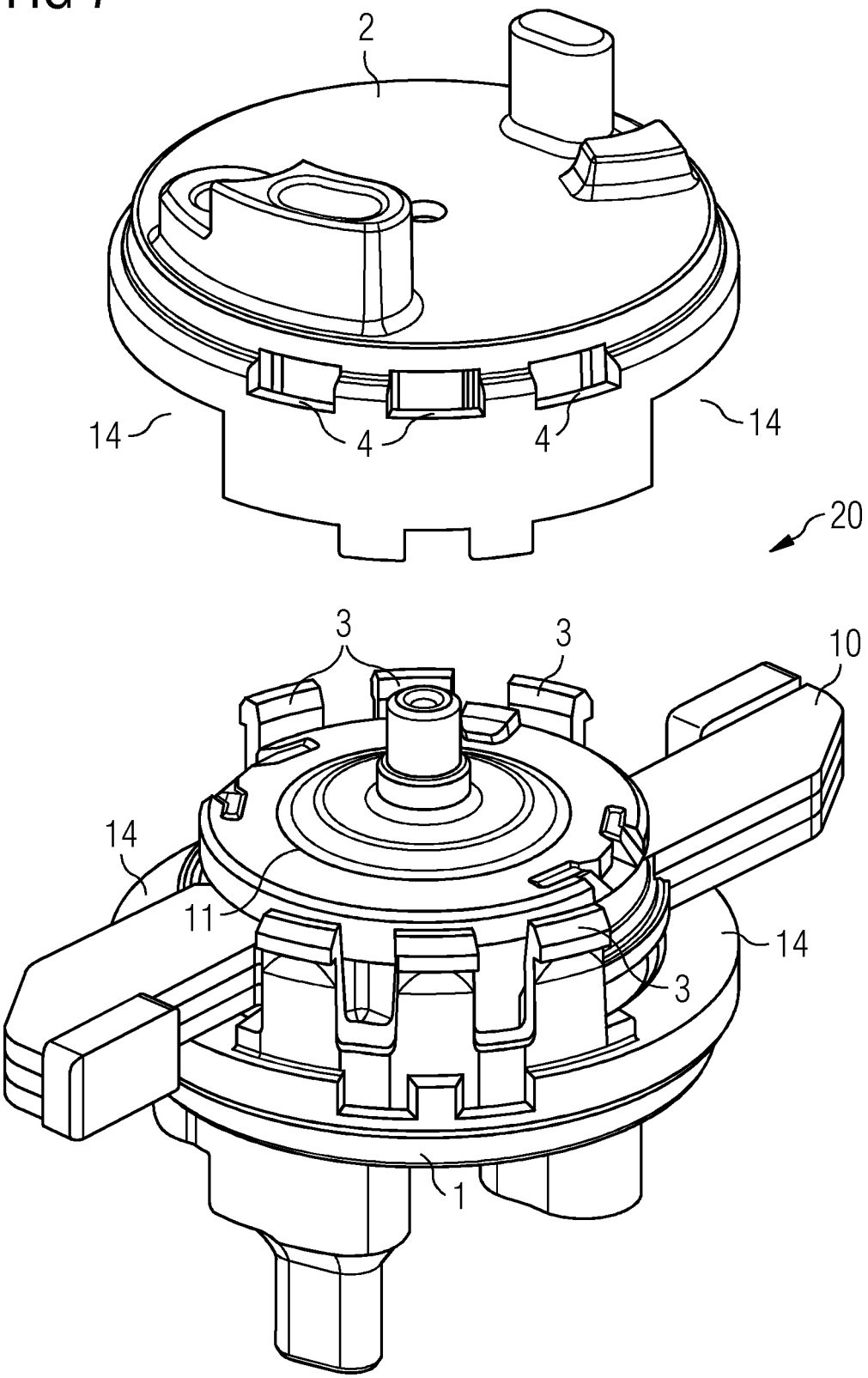
FIG. 7 shows the rotor housing according to FIG. 6, wherein a contact arm bridge with an opening mechanism is arranged in the first rotor housing element.

FIG. 7 shows another perspective representation of the rotor housing 20 according to FIG. 6. A contact arm bridge 10 with an opening mechanism 1 is arranged in a rotatably mounted manner in the first rotor housing element 1. The arms of the contact arm bridge 10 are moveably passed through the recesses 14 of the first rotor housing element 1 or the second rotor housing element 2. By latching the second rotor housing element 2 on the first rotor housing element 1, a secure form and if necessary also force-fit connection is established between the two rotor housing elements 1, 2. The contact arm bridge 10 and the opening mechanism 11 are mounted securely within the rotor housing elements 1, 2. In the connected state of the two rotor housing elements 1, 2, these withstand high loads.

Figure 8:
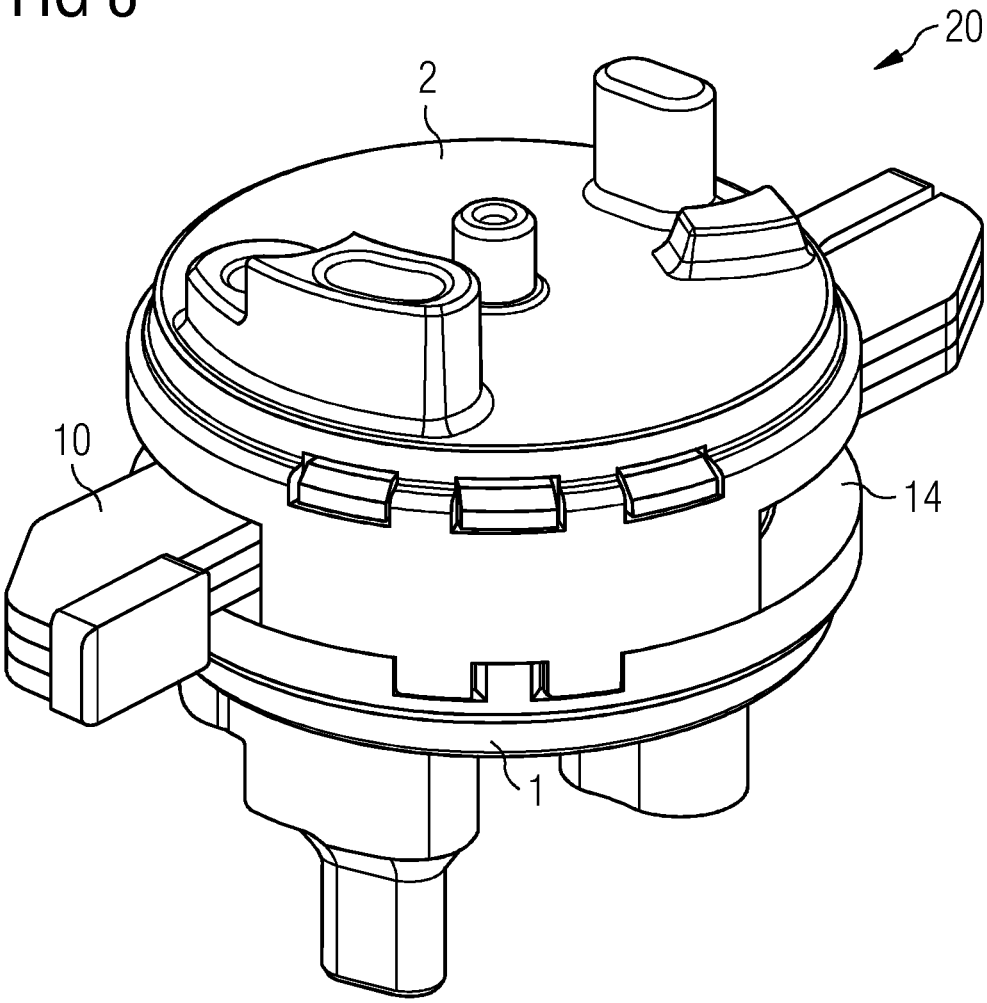
FIG. 8 shows the rotor housing according to FIG. 7, in the assembled state.

FIG. 8 shows a rotor housing 20 according to FIG. 7 when the two rotor housing elements 1, 2 are connected to one another. The contact arm bridge 10 is freely moveable in the recesses 14 of the rotor housing 20. The contact arm bridge 10 is moved by way of the opening mechanism.

Figure 9:
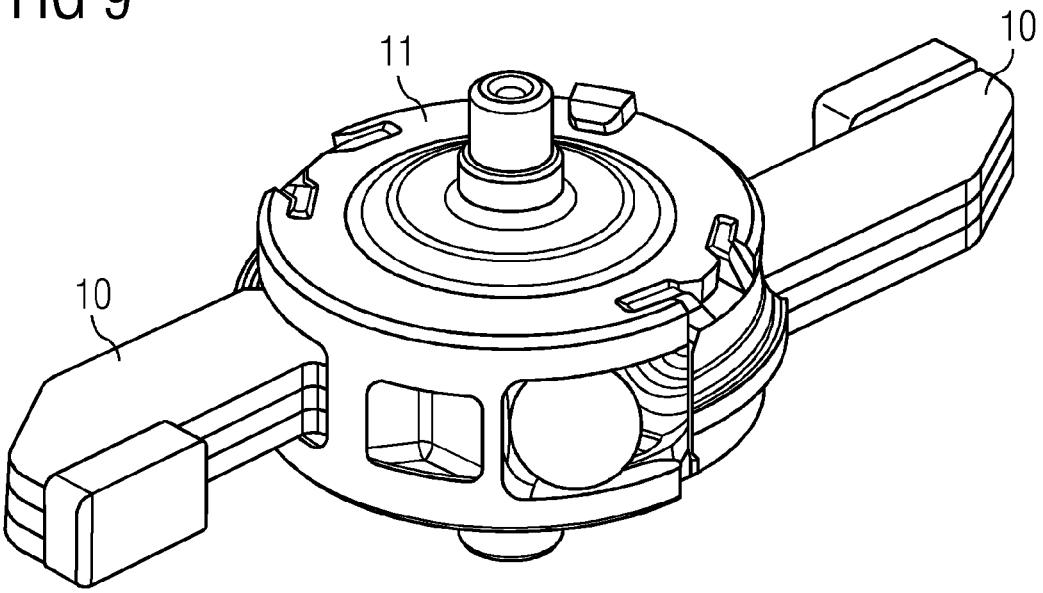
FIG. 9 shows a contact arm bridge with an opening mechanism, which can be surrounded at least partially by a rotor housing.

FIG. 9 shows a schematic representation of a perspective view of a contact arm bridge 10 with an opening mechanism 11. This contact arm bridge 10 with the opening mechanism 11 can be moveably mounted within the rotor housing 20 shown in FIGS. 1 to 8.

Figure 10:
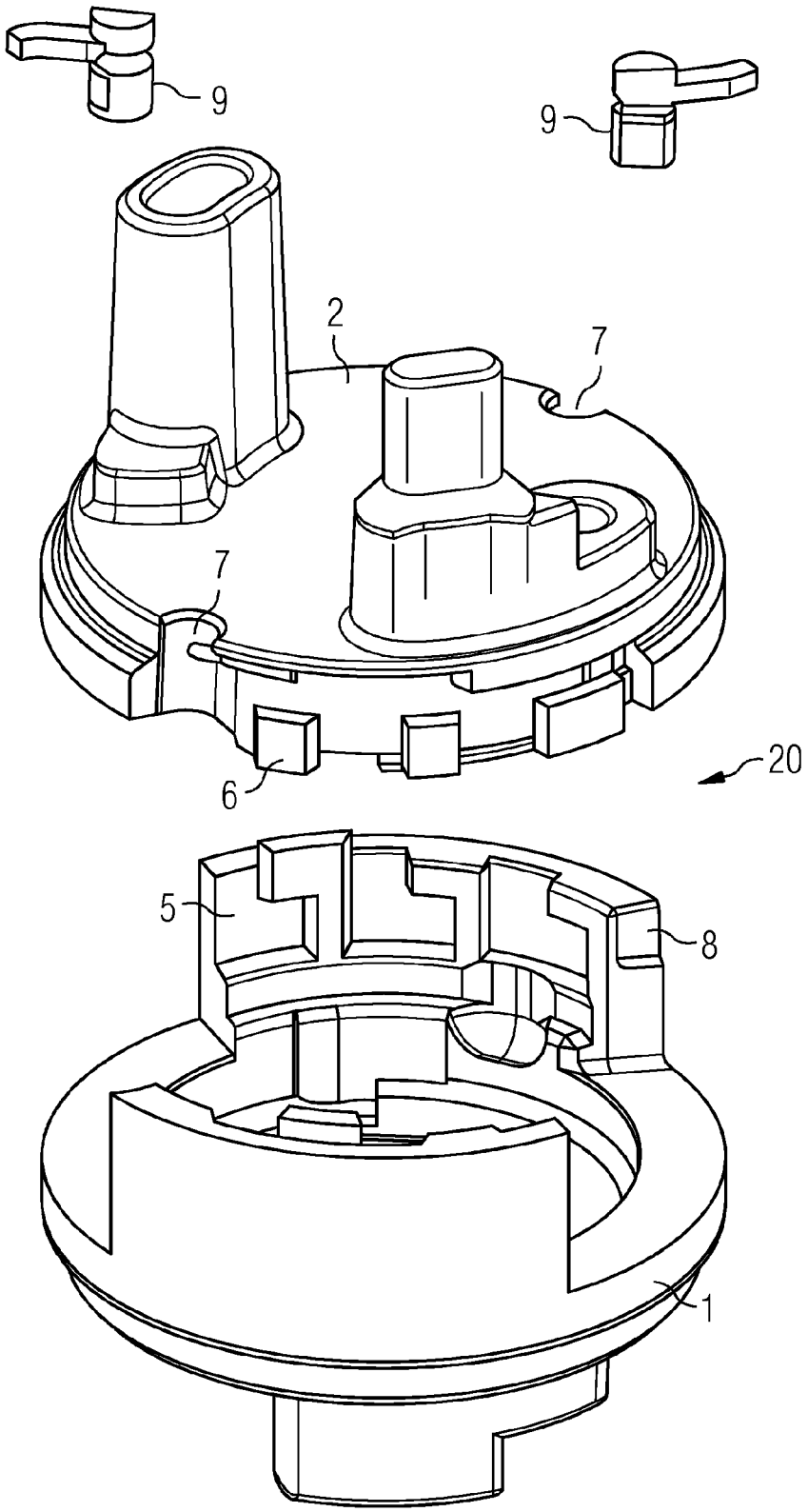
FIG. 10 shows the rotor housing similar to FIG. 1, having two arresting elements embodied as a molded part.
Figure 11:
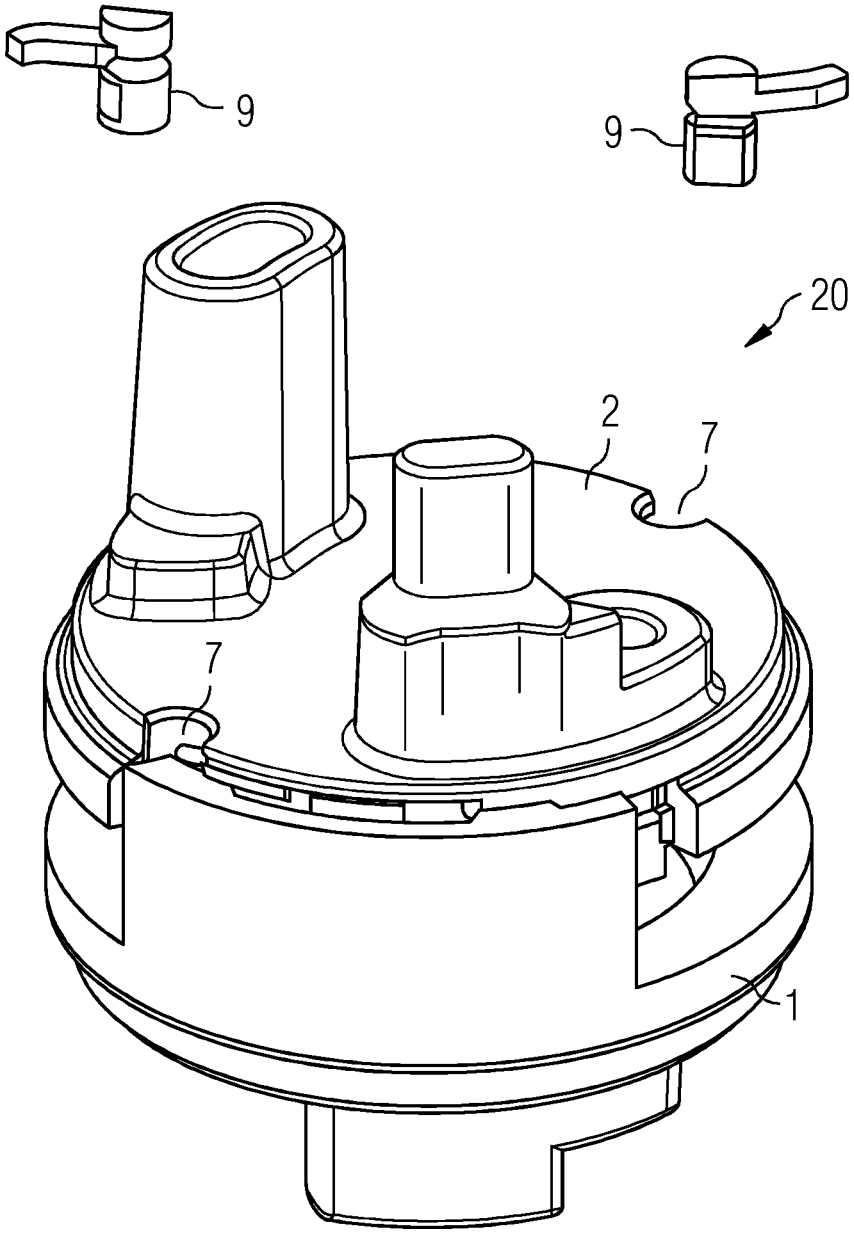
FIG. 11 shows the rotor housing according to FIG. 10 in the assembled state, having two arresting elements embodied as a molded part.
Figure 12:
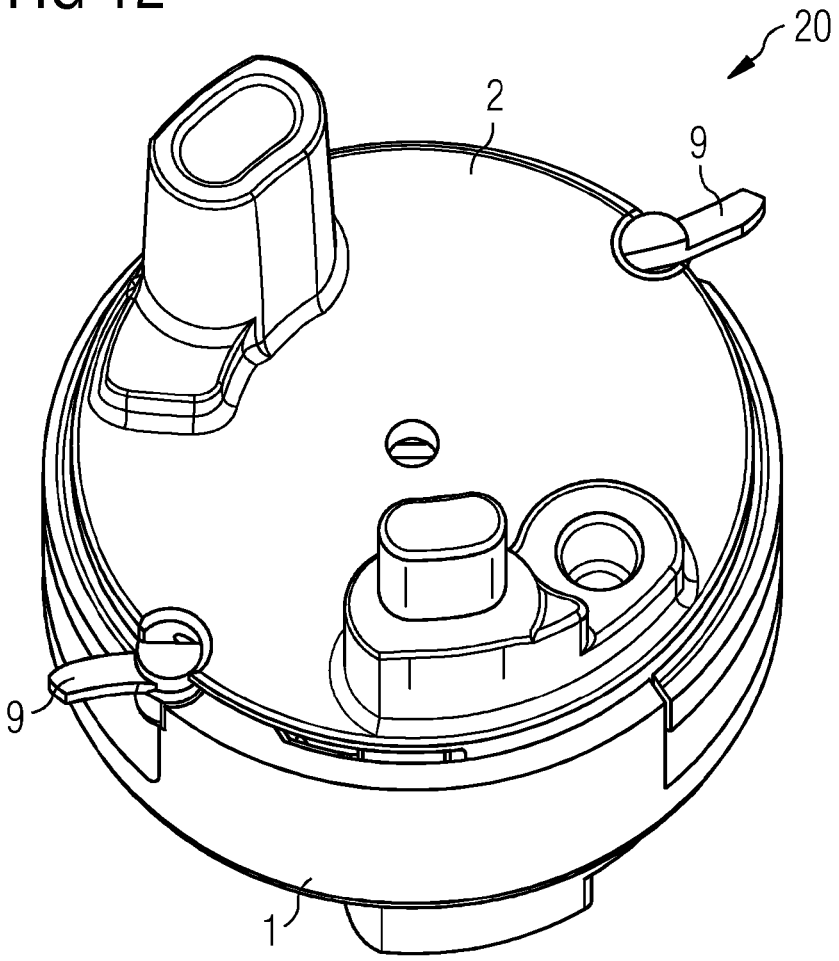
FIG. 12 shows the rotor housing according to FIG. 10 in the assembled state, which is secured by two arresting elements embodied as molded parts.
Figure 13:
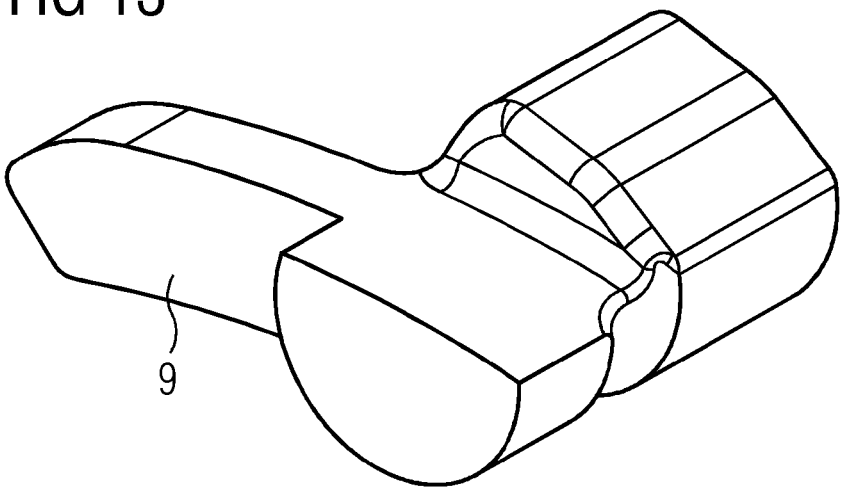
FIG. 13 shows an arresting element embodied as a molded part.

FIGS. 10 to 12 show a schematic representation in each instance of a rotor housing 20 for an electrical switching device, in particular for a contact circuit breaker, wherein the rotor housing 20 is embodied to mount a moveable contact arm bridge 10 and if necessary for an opening mechanism 11 for the contact arm bridge 10. In this embodiment variant of the rotor housing 20, the first and the second rotor housing element 1, 2 can be connected to one another in a form-fit manner by means of a bayonet fittings 5, 6, similar to the rotor housing 20 according to FIG. 1. FIG. 10 shows the rotor housing 20 in the non assembled state. FIG. 11 shows the rotor housing 20 according to FIG. 10 in the assembled state. Two arresting elements 9 embodied as molded parts are also shown in FIGS. 10 and 11 in each instance. These can be inserted into plug-in receptacles 7, 8 in the rotor housing elements 1, 2, in order to fix the first rotor housing element 1 and the second rotor housing element 2 in the assembled state to one another, see FIG. 12. FIG. 13 again shows an enlarged arresting element/plug-in element 9 embodied as a molded part. The fixing of the first rotor housing element 1 to the second rotor housing element 2 by means of the molded parts 9 can take place in particular by inserting the molded parts 9 into the plug-in receptacle 7, 8 and a subsequent rotation of the molded parts 9.

FIG. 13 once again shows an enlarged arresting element/plug-in element 9 embodied as a molded part.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 first rotor housing element
2 second rotor housing element
3 snap-fit hook
4 mating contour
5 first bayonet fitting contours on the first rotor housing element
6 second bayonet fitting contours on the second rotor housing element
7 plug-in receptacle on the first rotor housing element
8 plug-in receptacle on the second rotor housing element
9 arresting element/plug-in element
10 contact arm bridge
11 opening mechanism
12 flange section
13 base body
14 recess
20 rotor housing

What is claimed is:

1. A rotor housing of an electrical switching device, the rotor housing being embodied to mount a moveable contact arm bridge, the rotor housing comprising:

a first and a second rotor housing element;

a semi-circular flange extending from and along an outer peripheral surface of each of the first and the second rotor housing element; and interlocking elements formed on the outer peripheral surface of each of the semi-circular flanges, the first and second rotor housing elements being interlocked to one another in a form-fit manner via the interlocking elements, and, in the connected state, the first and second rotor housing elements surround the movable contact arm bridge at least in sections.

2. The rotor housing of claim 1, wherein the first and second rotor housing elements are connectable to one another in a form-fit manner by way of at least one bayonet fitting.

3. The rotor housing of claim 2, wherein at least one first bayonet fitting contour and at least one second bayonet fitting contour, receiving the at least one first bayonet fitting contour, are respectively embodied on the first rotor housing element and on the second rotor housing element.

4. The rotor housing of claim 1, further comprising an arresting element in direct contact with each of the first rotor housing element and the second rotor housing element thereby arresting rotation of the first rotor housing element relative to the second rotor housing element, provided in a state of the first and second rotor housing elements when connected by the interlocking elements.

5. The rotor housing of claim 1, wherein the first rotor housing element and the second rotor housing element each comprise a plug-in receptacle on an exterior surface thereof for receiving an arresting element, wherein the plug-in receptacles are arranged in the first and the second rotor housing element such that they are arranged flush with one another in order to receive the arresting element when the two rotor housing elements are fixedly connected.

6. The rotor housing of claim 5, wherein the arresting element is embodied as a pin or molded part.

7. The rotor housing of claim 1, wherein the first and the second rotor housing element are embodied from a thermosetting material.

8. The rotor housing of claim 1, wherein the first rotor housing element comprises at least one snap-fit hook and the second rotor housing element comprises at least one mating contour into which the at least one snap-fit hook is engageable.

9. The rotor housing of claim 8, wherein three or more snap-fit hooks and three or more respective mating contours are provided, each of which is at a distance from one another on the first rotor housing and on the second rotor housing element.

10. The rotor housing of claim 8, wherein the at least one snap-fit hook is embodied to be spring elastic.

11. The rotor housing of claim 1, wherein the first and the second rotor housing element are embodied from thermoplastic material.

12. The rotor housing of claim 1, wherein the rotor housing elements comprise drilled holes through which a rotor shaft can pass.

13. The rotor housing of claim 1, wherein at least one of the rotor housing elements is embodied as a cap, comprising a base body and a flange section, wherein at least one recess for moveably guiding the contact arm bridge is embodied in the flange section.

14. The rotor housing of claim 1, wherein the first and the second rotor housing element are connectable to one another in a force-fit manner.

15. An electrical switching device, comprising:

a moveably mounted contact arm bridge;

an opening mechanism; and the rotor housing of claim 1, for mounting the moveable contact arm bridge.

16. The rotor housing of claim 1, wherein the electrical switching device is a circuit-breaker.

17. The rotor housing of claim 9, wherein the at least one snap-fit hook is embodied to be spring elastic.

18. The electrical switching device of claim 15, wherein the electrical switching device is a compact circuit breaker.

19. The rotor housing of claim 1, further comprising at least one rotation preventing element interposed between the first and second rotor housing elements in aligned openings in each of the flanges.

* * * * *